US005090124A

United States Patent [19]

Althaus

[11] Patent Number: 5,090,124

[45] Date of Patent: Feb. 25, 1992

[54] RAZOR BLADE UNIT

[75] Inventor: Wolfgang Althaus, Wuppertal, Fed. Rep. of Germany

[73] Assignee: Wilkinson Sword Gesellschaft mit beschrankter Haftung, Solingen, Fed. Rep. of Germany

[21] Appl. No.: 656,466

[22] Filed: Feb. 19, 1991

Related U.S. Application Data

[63] Continuation of Ser. No. 235,950, Aug. 24, 1988, abandoned, which is a continuation-in-part of Ser. No. 139,816, Dec. 30, 1987, Pat. No. 4,916,814.

[30] Foreign Application Priority Data

Aug. 25, 1987 [DE] Fed. Rep. of Germany ... 8711506[U]

[51] Int. Cl.[5] ..... B26B 21/00

[52] U.S. Cl. ..... 30/50; 30/78; 30/346.5

[58] Field of Search ..... 30/47-50, 30/77-78, 32, 346.58, 346.5

[56] References Cited

U.S. PATENT DOCUMENTS 1,035,548 8/1912 Dickenson ..... 30/78

3,505,734 4/1970 Iten ..... 30/346.58

*Primary Examiner*—Douglas D. Watts

*Attorney, Agent, or Firm*—Robert W. Becker & Associates

[57] ABSTRACT

A razor blade unit includes a support member and at least one razor blade secured to the support member with a cutting edge extending from the support member. A wire is wrapped around at least a portion of the support member and the cutting edge of the razor blade with several space side-by-side windings traversing the cutting edge at an angle substantially perpendicular to the cutting edge. The strand is preferably a metal wire having a diameter of less than about 0.1 mm. The support member has grooves at its edges in which the wire is seated to prevent slip-page of the wire in a direction transversed to the edge of the blade.

6 Claims, 1 Drawing Sheet

RAZOR BLADE UNIT

This is a continuation of application Ser. No. 07/235,950, filed Aug. 24, 1988 which is a continuation-in-part of Ser. No. 07/139,866 12/30/87 now U.S. Pat. No. 4,916,814.

BACKGROUND OF INVENTION

The invention concerns a razor blade unit for a safety razor, where a razor blade or two razor blades parallel to each other are embedded in a plastic part, and the cutting edges of the blades are in part provided with a cover.

There are known razor blade units for wet safety razors, where a single or a twin razor blade is embedded in a plastic part. With the twin blade arrangement, the cutting edges of the two razor blades are arranged to be offset from each other.

A disadvantage of these razor blade units is that during the shaving process, unevennesses of the skin can be picked up by the razor blades and cause skin injuries and skin irritations. Sometimes such injuries are invisible.

To eliminate this disadvantage, it has already been proposed to cover the cutting edge of the razor blade with a thin metal sheet divided into cutting and non-cutting segments. However, such a cover is not suitable for modern razor blade units or for optimum shaving, since it greatly reduces the effective cutting surface and does not offer protection against skin folds. Such skin folds occur during the shaving process and cause skin injuries Moreover, shaving resistance is also increased, and this causes further irritation of the skin. Finally the previously proposed cover is expensive and costly.

SUMMARY OF THE INVENTION

It is an object of the present invention to improve the shaving properties of known razor blade units.

According to one embodiment of the present invention, the plastic part and the razor blades are wrapped with a wire with several side-by-side windings in the area where the surface of the razor blade unit contacts the skin. Portions of the windings run parallel to the direction of shaving and at intervals from each other.

A razor blade unit with a protective wire configured in accordance with this technical teaching improves the shaving properties considerably. The wire prevents the formation of a skin fold so that even invisible skin injuries are avoided. In addition, the wire reduces the necessary shaving resistance and the frictional force which occurs in the top cap of the razor blade unit to the extent of about 50% of the total frictional force.

The wire preferably consists of metal, as metal has a relatively low coefficient of friction with skin so that the necessary shaving resistance is reduced to a minimum.

One version of the invention uses a wire diameter of less than 0.1 mm so that the effective shaving surface is only minimally reduced.

The wire preferably is run at least in part in grooves formed in the plastic part. These guide grooves ensure that the wire windings are unable to slip sideways, particularly during the shaving process.

Additional objects and advantages of the invention will be set forth in the description which follows, and in part will be obvious from the description or may be learned by practice of the invention. The objects and advantages of the invention may be realized and obtained by means of the instrumentalities and combinations particularly pointed out in the appended claims.

BRIEF DESCRIPTION OF DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention there is provided a razor blade unit for a wet safety razor, which can be fixed to a handle (not shown). The razor blade unit includes a support member such as a plastic part 1, in which two razor blades 2,2' are embedded. The cutting edges 3,3' of razor blades 2, 2' run parallel to and are offset from each other.

Figure 1:
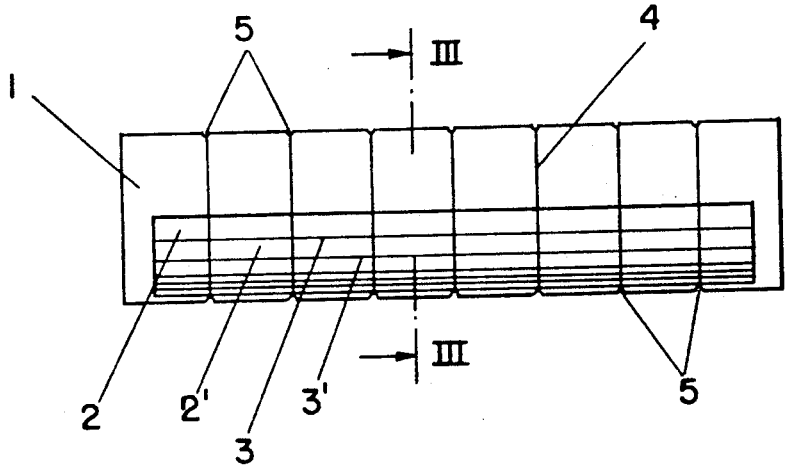
FIG. 1 shows a front view of the razor blade unit incorporating the teachings of the present invention.
Figure 2:
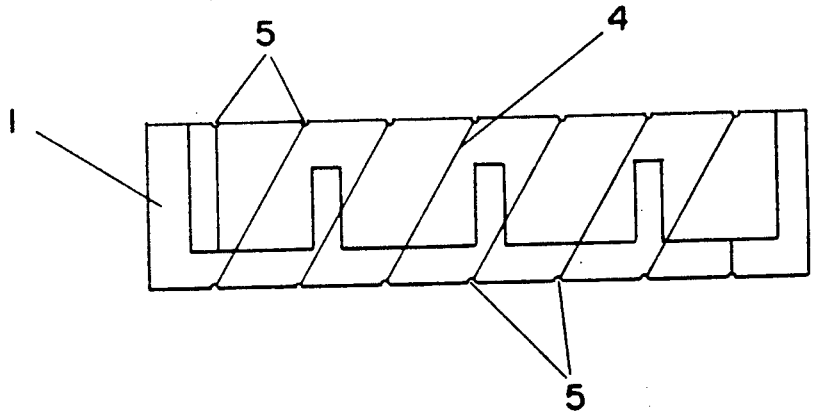
FIG. 2 shows a rear view of the razor blade unit of FIG. 1.
Figure 3:
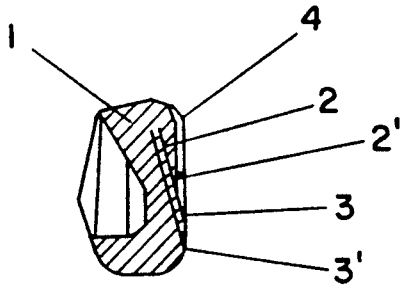
FIG. 3 shows a sectional view along line III—III of FIG. 1.

The plastic part 1 is wrapped together with the razor blades 2,2' by means of a strand such as a wire 4. This wire 4 forms spaced strand portions from the generally helical windings. These spaced strand portions run at intervals to each other, as can be seen from FIGS. 1 and 2. The front of the razor blade unit shown in FIG. 1 forms a contact area where the razor blades and support member is proximate to the skin while shaving. At the contact area, the windings of wire 4 run parallel to the direction of shaving, while at the rear of the razor blade unit shown in the FIG. 2 the windings are at an angle. The plurality of spaced strand portions cover portions of the contact area and define a plurality of uninterrupted exposure gaps on the contact area which extend transverse to the cutting edge.

The wire 4 preferably is made of metal and has a diameter or less than 0.1 mm. Grooves 5 in plastic part 1 constitute means for preventing the strand portions of wire 4 from sliding in a direction transverse to the cutting edge.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A razor blade unit for a safety razor, the unit comprising:

a support member having a contact surface for engaging the skin during shaving, the contact surface having a leading edge region and a trailing edge region;

at least one razor blade embedded in the support member and having a cutting edge extending from the contact surface of the support member intermediate said leading and trailing edge regions, the leading and trailing edge regions as well as the cutting edge of the razor blade being oriented for simultaneous engagement with the skin during shaving; and a plurality of spaced strands arranged along the contact surface and extending over the razor blade at an angle substantially perpendicular to the cutting edge, said strands covering spaced portions of the contact surface and the cutting edge of the razor blade and defining a plurality of uninterrupted exposure gaps on the contact surface that extend perpendicular to the cutting edge.

2. A razor blade unit as set forth in claim 1 wherein the strand portions are made of metal.

3. A razor blade unit as set forth in claim 1 wherein the strand portions are formed of a single wire having side-by-side windings.

4. A razor blade unit as set forth in claim 1 wherein the support member includes means for keeping the strand portions from sliding in a direction transverse to the cutting edge.

5. A razor blade unit as set forth in claim 4 wherein the means for keeping the strand portions from sliding includes grooves in the support member in which the strand portions are seated.

6. A razor blade unit as set forth in claim 1 wherein the strand portions have a diameter of less than about 0.1 mm.

* * * * *